US010561261B2

(12) United States Patent
Sorensen et al.

(10) Patent No.: US 10,561,261 B2
(45) Date of Patent: Feb. 18, 2020

(54) STACKABLE CONTAINER SYSTEM

(71) Applicant: Runway Blue, LLC, Alpine, UT (US)

(72) Inventors: Steven M. Sorensen, Alpine, UT (US); Kim L. Sorensen, Alpine, UT (US); David O. Meyers, East Layton, UT (US)

(73) Assignee: Runway Blue, LLC, Alpine, UT (US)

( * ) Notice: Subject to any disclaimer, the term of this patent is extended or adjusted under 35 U.S.C. 154(b) by 86 days.

(21) Appl. No.: 15/979,198

(22) Filed: May 14, 2018

(65) Prior Publication Data

US 2018/0332986 A1 Nov. 22, 2018

Related U.S. Application Data

(63) Continuation of application No. 15/149,095, filed on May 7, 2016, now Pat. No. 10,165,877, which is a (Continued)

(51) Int. Cl.
*B65D 21/00* (2006.01)
*A47G 19/22* (2006.01)
(Continued)

(52) U.S. Cl.
CPC ..... *A47G 19/2205* (2013.01); *A47G 19/2272* (2013.01); *A47G 19/23* (2013.01);
(Continued)

(58) Field of Classification Search
CPC .. B65D 21/0228; B65D 51/242; B65D 51/28; B65D 81/3205; B65D 21/0219;
(Continued)

(56) References Cited

U.S. PATENT DOCUMENTS 1,037,051 A 8/1912 Ramsey
1,094,469 A 8/1914 Pick
(Continued)

FOREIGN PATENT DOCUMENTS

AU 2013313340 B2 2/2017
CA 2882559 C 7/2017
(Continued)

OTHER PUBLICATIONS

Australian Examination Report 1, as issued in connection with Australian Application No. 2013231025, dated Mar. 11, 2015, 4 pgs.
(Continued)

*Primary Examiner* — Ernesto A Grano
(74) *Attorney, Agent, or Firm* — Sterne, Kessler, Goldstein & Fox P.L.L.C.

(57) ABSTRACT

The present invention is directed to a stackable container system. The stackable container system can comprise a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids. In addition to storing beverage ingredients, the stackable container system can also be used to store other edible and inedible ingredients.

20 Claims, 3 Drawing Sheets

Related U.S. Application Data continuation of application No. 13/633,864, filed on Oct. 2, 2012, now Pat. No. 9,492,024.

(51) Int. Cl.

| | |
|---|---|
| ***B65D 81/32*** | (2006.01) |
| ***B65D 21/02*** | (2006.01) |
| ***A47G 19/23*** | (2006.01) |
| ***B65D 25/04*** | (2006.01) |
| ***B65D 41/04*** | (2006.01) |
| ***B65D 47/06*** | (2006.01) |

(52) U.S. Cl.

CPC ..... *B65D 21/0228* (2013.01); *B65D 25/04* (2013.01); *B65D 41/04* (2013.01); *B65D 47/065* (2013.01); *B65D 81/3205* (2013.01); *F04C 2270/0421* (2013.01)

(58) Field of Classification Search

CPC .. B65D 47/0895; B65D 47/065; B65D 41/04; A47G 19/2205; A47G 19/2272; A47G 19/23

USPC ..... 215/329

See application file for complete search history.

(56) References Cited

U.S. PATENT DOCUMENTS 1,389,732 A 9/1921 Baron
1,479,053 A 1/1924 Brooks
1,573,620 A 2/1926 Alston
2,026,701 A 1/1936 Pearl
2,056,879 A 10/1936 Winterhalter et al.
2,272,867 A 2/1942 Cobel
2,514,573 A 7/1950 Harrison
2,573,378 A 10/1951 Zurlinden
2,574,876 A 11/1951 Lebus
2,575,299 A 11/1951 Scheel
2,638,253 A 5/1953 Mueller
2,748,997 A 6/1956 Richmond, Sr.
2,752,971 A 7/1956 Tupper
2,754,866 A 7/1956 Coltman, Jr.
3,022,925 A 2/1962 Daniell
3,091,361 A 5/1963 Gawron
3,143,205 A 8/1964 Ruderian
3,144,016 A 8/1964 Basci
3,168,226 A 2/1965 Underwood et al.
3,348,716 A 10/1967 Yuichi
3,369,691 A 2/1968 Wei
3,552,548 A 1/1971 Wallestad et al.
3,770,160 A 11/1973 Flider
3,820,692 A 6/1974 Swett et al.
D233,116 S 10/1974 Swett et al.
4,022,352 A 5/1977 Pehr
4,136,799 A 1/1979 Albert
4,158,902 A 6/1979 Chernack et al.
4,170,302 A 10/1979 Baca
D261,088 S 10/1981 Akimov et al.
4,399,926 A 8/1983 Eidels-Dubovoy
4,457,458 A 7/1984 Heinol
4,474,303 A 10/1984 Maccise
4,485,923 A 12/1984 Schwaikert
4,519,518 A 5/1985 Wiles et al.
4,537,044 A 8/1985 Putnam
4,735,333 A 4/1988 Lay et al.
4,776,501 A 10/1988 Ostrowsky
4,805,790 A 2/1989 Leonetti et al.
4,930,636 A 6/1990 Meadows
4,932,225 A 6/1990 Bighouse
5,035,324 A 7/1991 Bertrand
5,065,877 A 11/1991 Karppinen et al.
5,065,911 A 11/1991 Rohr et al.
5,088,614 A 2/1992 Dumestre
D330,862 S 11/1992 Shibley et al.
5,228,584 A 7/1993 Williams, Jr.
D342,898 S 1/1994 Cane
5,289,930 A 3/1994 Inouye
D350,460 S 9/1994 Picozza et al.
5,386,922 A 2/1995 Jordan
D356,499 S 3/1995 Cautereels et al.
5,409,128 A * 4/1995 Mitchell ..... B65D 21/022 206/508
5,415,309 A 5/1995 Wang
5,501,338 A 3/1996 Preston
5,547,111 A 8/1996 Geiger et al.
5,609,277 A 3/1997 McDonald
D382,968 S 8/1997 Giles et al.
D404,305 S 1/1999 De Baschmakoff
D405,654 S 2/1999 Moran
D421,547 S 3/2000 Demers
6,161,713 A 12/2000 Krich
6,283,333 B1 9/2001 Knickerbocker et al.
6,299,005 B1 10/2001 Higgins
6,379,032 B1 4/2002 Sorensen
D458,081 S 6/2002 Bodum
D461,420 S 8/2002 Kerman
D497,431 S 10/2004 Bentley
6,832,412 B2 12/2004 Kim
6,860,397 B1 3/2005 Walters, Jr.
D504,273 S 4/2005 Ancona
D508,185 S 8/2005 Gauss
D510,235 S 10/2005 Sorensen
D518,336 S 4/2006 Hirani
7,073,678 B1 7/2006 Dibdin et al.
D526,827 S 8/2006 Allen et al.
D528,862 S 9/2006 Li
D529,339 S 10/2006 Carreno et al.
D532,650 S 11/2006 de Groote
D543,454 S 5/2007 Leoncavallo et al.
D546,131 S 7/2007 Morales
D547,607 S 7/2007 Forsman
D565,353 S 4/2008 Roth et al.
D574,190 S 8/2008 Homma
D580,227 S 11/2008 Roth et al.
D586,184 S 2/2009 Miller et al.
D587,069 S 2/2009 Bodum
D589,751 S 4/2009 Liu et al.
D592,913 S 5/2009 Pinelli et al.
7,533,783 B2 5/2009 Choi et al.
D593,811 S 6/2009 Carreno
D599,664 S 9/2009 Fujinami et al.
D604,103 S 11/2009 Alviar et al.
D609,970 S 2/2010 Richau et al.
D613,110 S 4/2010 Lane et al.
D622,089 S 8/2010 Daniel et al.
D622,554 S 8/2010 Carreno
7,806,284 B2 10/2010 Mangano
D626,837 S 11/2010 Meyers et al.
D626,838 S 11/2010 Meyers et al.
D628,483 S 12/2010 McKinney et al.
D629,657 S 12/2010 Carreno
7,870,980 B2 1/2011 Wilson et al.
D641,594 S 7/2011 Huang
D644,065 S 8/2011 Llerena
8,020,257 B2 9/2011 Merten et al.
D646,546 S 10/2011 Robinson et al.
D646,919 S 10/2011 Nilsson
D647,760 S 11/2011 Pearson
D652,256 S 1/2012 Eyal
D655,131 S 3/2012 Nilsson
D655,967 S 3/2012 Bodum
D656,357 S 3/2012 Enghard
D661,551 S 6/2012 Gilbert
D666,047 S 8/2012 Lin
D666,061 S 8/2012 Ying
D667,694 S 9/2012 Meyers et al.
8,302,796 B1 11/2012 Johnson
8,342,349 B2 1/2013 Lu
D677,121 S 3/2013 Meyers et al.
D686,885 S 7/2013 Meyers et al.
D686,886 S 7/2013 Meyers et al.
D686,887 S 7/2013 Meyers et al.
D686,888 S 7/2013 Meyers et al.

(56) References Cited

U.S. PATENT DOCUMENTS

| | | | |
|---|---|---|---|
| D696,079 | S | 12/2013 | Meyers et al. |
| D696,551 | S | 12/2013 | Meyers et al. |
| D697,798 | S | 1/2014 | Sorensen et al. |
| 8,695,830 | B2 | 4/2014 | Meyers et al. |
| 8,833,586 | B2 | 9/2014 | Meyers et al. |
| 8,844,746 | B2 | 9/2014 | Meyers et al. |
| 8,939,305 | B2 | 1/2015 | Meyers et al. |
| 9,120,598 | B2 | 9/2015 | Meyers et al. |
| 9,216,843 | B2 | 12/2015 | Sorensen et al. |
| D748,478 | S | 2/2016 | Sorensen et al. |
| 2002/0074334 | A1 | 6/2002 | Karp |
| 2003/0085228 | A1 | 5/2003 | Oakes |
| 2003/0150857 | A1 | 8/2003 | Tsai |
| 2004/0200845 | A1 | 10/2004 | Watzke et al. |
| 2004/0217139 | A1 | 11/2004 | Rothe et al. |
| 2004/0262306 | A1 | 12/2004 | Smith |
| 2005/0045634 | A1 | 3/2005 | Ward et al. |
| 2005/0045636 | A1 | 3/2005 | Lown et al. |
| 2005/0205577 | A1 | 9/2005 | Park |
| 2006/0186014 | A1 | 8/2006 | Ramanujam et al. |
| 2006/0213912 | A1 | 9/2006 | Zaytoun |
| 2007/0012693 | A1 | 1/2007 | Kummer |
| 2007/0084863 | A1 | 4/2007 | Mendez |
| 2007/0175931 | A1 | 8/2007 | Leoncavallo et al. |
| 2008/0006629 | A1 | 1/2008 | Roth et al. |
| 2008/0099514 | A1 | 5/2008 | Carter et al. |
| 2009/0018884 | A1 | 1/2009 | McConnell et al. |
| 2009/0178940 | A1 | 7/2009 | Said |
| 2009/0188884 | A1 | 7/2009 | Nelson et al. |
| 2009/0188933 | A1 | 7/2009 | Daams |
| 2009/0301990 | A1 | 12/2009 | Cresswell et al. |
| 2010/0187235 | A1 | 7/2010 | Chen |
| 2010/0200438 | A1 | 8/2010 | Davies |
| 2010/0206835 | A1 | 8/2010 | Yu |
| 2010/0224631 | A1 | 9/2010 | Roth et al. |
| 2010/0282703 | A1 | 11/2010 | Yang |
| 2011/0017760 | A1 | 1/2011 | Newman |
| 2011/0083300 | A1 | 4/2011 | Heger et al. |
| 2011/0253733 | A1 | 10/2011 | Meyers et al. |
| 2014/0069917 | A1* | 3/2014 | Meyers ..... B65D 21/022 220/23.88 |

FOREIGN PATENT DOCUMENTS

| | | | |
|---|---|---|---|
| CN | 201139196 | Y | 10/2008 |
| CN | 101352283 | A | 1/2009 |
| CN | 202193280 | U | 4/2012 |
| CN | 104619598 | A | 7/2017 |
| DE | 20304941 | U1 | 7/2003 |
| EP | 2892814 | B1 | 6/2018 |
| GB | 2487787 | A | 8/2012 |
| JP | 09-240748 | | 9/1997 |
| JP | 2001-299876 | A | 10/2001 |
| JP | 2006103793 | A | 4/2006 |
| JP | 2007-176581 | A | 7/2007 |
| JP | 2008-247404 | A | 10/2008 |
| JP | 2009-029516 | A | 2/2009 |
| KR | 20-0417757 | | 5/2006 |
| KR | 10-2010-0092252 | | 8/2010 |
| MX | 356250 | | 5/2018 |
| WO | 98/22358 | A1 | 5/1998 |
| WO | 2008/026063 | A2 | 3/2008 |
| WO | 2010-034340 | A1 | 4/2010 |
| WO | 2012-017222 | A1 | 2/2012 |

OTHER PUBLICATIONS

Australian Examination Report 1, as issued in connection with Australian Application No. 2013313340, dated Sep. 8, 2015, 5 pgs.
Australian Examination Report 2, as issued in connection with Australian Application No. 2013313340, dated Sep. 5, 2016, 3 pgs.
Canadian Office Action, as issued in connection with Canadian Application No. 2828285, dated Jun. 12, 2014, 2 pgs.
Canadian Office Action, as issued in connection with Canadian Application No. 2882559, dated Mar. 3, 2016, 4 pgs.
Chinese Office Action, as issued in connection with Chinese Application No. 201380001117.5, dated Jun. 30, 2015, 7 pgs.
Chinese Office Action, as issued in connection with Chinese Application No. 201380001117.5, dated May 4, 2016, 3 pgs.
Chinese Office Action, as issued in connection with Chinese Application No. 201380001117.5, dated Mar. 20, 2017, 8 pgs.
Chinese Search Report, as issued in connection with Chinese Application No. 201380047053.2, dated Oct. 22, 2015, 3 pgs.
Chinese Office Action, as issued in connection with Chinese Application No. 201380047053.2, dated Oct. 30, 2015, 6 pgs.
Chinese Office Action, as issued in connection with Chinese Application No. 201380047053.2, dated Sep. 1, 2016, 5 pgs.
European Extended Search Report, as issued in connection with European Application No. 13834401.5, dated Mar. 24, 2016, 6 pgs.
European Extended Search Report, as issued in connection with European Application No. 13834401.5, dated Aug. 4, 2016, 11 pgs.
European Communication, as issued in connection with European Application No. 13834401.5, dated Jun. 21, 2017, 4 pgs.
European Extended Search Report, as issued in connection with European Application No. 13844241.3, dated Jul. 9, 2015, 8 pgs.
European Communication, as issued in connection with European Application No. 13844241.3, dated Dec. 9, 2016, 5 pgs.
European Communication, as issued in connection with European Application No. 13844241.3, dated Sep. 22, 2017, 4 pgs.
Japanese Office Action, as issued in connection with Japanese Application No. 2015-528488, dated Mar. 28, 2015, 5 pgs.
Korean Office Action, as issued in connection with Korean Application No. 10-2015-7006591, dated Mar. 30, 2016, 16 pgs.
Mexican Office Action, as issued in connection with Mexican Application No. MX/a/2014/005263, dated Jul. 2016, 2 pgs.
Mexican Office Action, as issued in connection with Mexican Application No. MX/a/2015/002543, dated Sep. 2017, 2 pgs.
International Search Report and Written Opinion, as issued in connection with PCT Application No. PCT/US2011/026508, dated Sep. 29, 2011, 6 pgs.
International Search Report and Written Opinion, as issued in connection with PCT Application No. PCT/US2012/054483, dated Nov. 16, 2012, 6 pgs.
International Search Report and Written Opinion, as issued in connection with PCT Application No. PCT/US2012/054497, dated Nov. 20, 2012, 6 pgs.
International Search Report and Written Opinion, as issued in connection with PCT Application No. PCT/US2013/020868, dated Mar. 26, 2013, 7 pgs.
International Search Report and Written Opinion, as issued in connection with PCT Application No. PCT/US2013/047161, dated Nov. 20, 2013, 8 pgs.
International Search Report and Written Opinion, as issued in connection with PCT Application No. PCT/US2013/052132, dated Aug. 16, 2013, 13 pgs.
Core 77, http://www.core77.com/blog/materials/kor.sub.--one.sub.--water.sub.--vessel.sub.--actual.sub.--size.sub.--10211.asp, accessed Apr. 20, 2010, 6 pgs.
Fit Sugar, www.fitsugar.com/2496788, accessed Apr. 20, 2010, 10 pgs.
Goodlifer, http://goodlifter.com/2009/02/360-paper-water-bottle/, accessed Apr. 20, 2010, 9 pgs.
Kor One, http://www.korwater.com/buyONE, accessed Apr. 20, 2010, 1 pg.
Koyono, http://www.koyono.com/KOR-ONE-Green-Zen-Water-Hydration-Vessel.sub--.--p/kor-one.htm, accessed Apr. 20, 2010, 7 pgs.
Thermos, http://www.shopthermos.com/detail/TMS+HP4000GR6, accessed Apr. 20, 2010, 1 pg.
Extended European Search Report dated Nov. 29, 2018 as received in European Application No. 18177298.9 (10 pgs).

* cited by examiner

STACKABLE CONTAINER SYSTEM

CROSS-REFERENCE TO RELATED APPLICATIONS

The present application is a continuation of U.S. patent application Ser. No. 15/149,095 filed on May 7, 2016, which is a continuation of U.S. patent application Ser. No. 13/633,864 filed on Oct. 2, 2012. The Ser. No. 15/149,095 application and the Ser. No. 13/633,864 application are incorporated herein by reference.

BACKGROUND OF THE INVENTION

Background

Beverage bottles or containers have become widely used. Such containers are often used to mix ingredients. For example, many people use these containers to mix nutritional powders into water or another liquid for consumption in conjunction with exercise.

It is often desirable to delay the mixing of the ingredients until an appropriate time. However, because such containers are often used on-the-go, it can be difficult to maintain the ingredients separate until the desired time. For example, some may use multiple containers to store the ingredients of a protein shake until after a workout is finished. Similarly, one or more separate containers may also be used to store supplements, such as vitamins or other pills, which are not mixed in the container.

Keeping track of multiple containers can be burdensome. To address this, some beverage containers have been developed that are configured to allow one or more additional containers to be attached to the beverage container. The additional containers can be used to store ingredients to be mixed in the beverage container at a later time, or to separately store other contents such as pills

Brief Summary

The present invention is directed to a stackable container system. The stackable container system can be used to store ingredients for a beverage, or ingredients or substances for other edible or inedible mixes or purposes.

In one embodiment, a stackable container system of the present invention comprises a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, a stackable container system of the present invention comprises a beverage container, a beverage container lid, a plurality of smaller containers, a plurality of smaller container lids, and a divider that is sized to be inserted into at least one of the plurality of smaller containers when a smaller container lid is attached to the smaller container. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, the stackable a container system of the present invention comprises a container, a container lid, a plurality of smaller containers, and a plurality of smaller container lids. The bottom of the container is configured to allow the container to be interlocked with the top of any of the at least one smaller container lid when the smaller container lid is secured to one of the at least one smaller container.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention is directed to a stackable container system. The stackable container system can be used to store ingredients for a beverage, or ingredients or substances for other edible or inedible mixes or purposes.

In one embodiment, a stackable container system of the present invention comprises a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, a stackable container system of the present invention comprises a beverage container, a beverage container lid, a plurality of smaller containers, a plurality of smaller container lids, and a divider that is sized to be inserted into at least one of the plurality of smaller containers when a smaller container lid is attached to the smaller container. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, the stackable a container system of the present invention comprises a container, a container lid, a plurality of smaller containers, and a plurality of smaller container lids. The bottom of the container is configured to allow the container to be interlocked with the top of any of the at least one smaller container lid when the smaller container lid is secured to one of the at least one smaller container.

Figure 1:
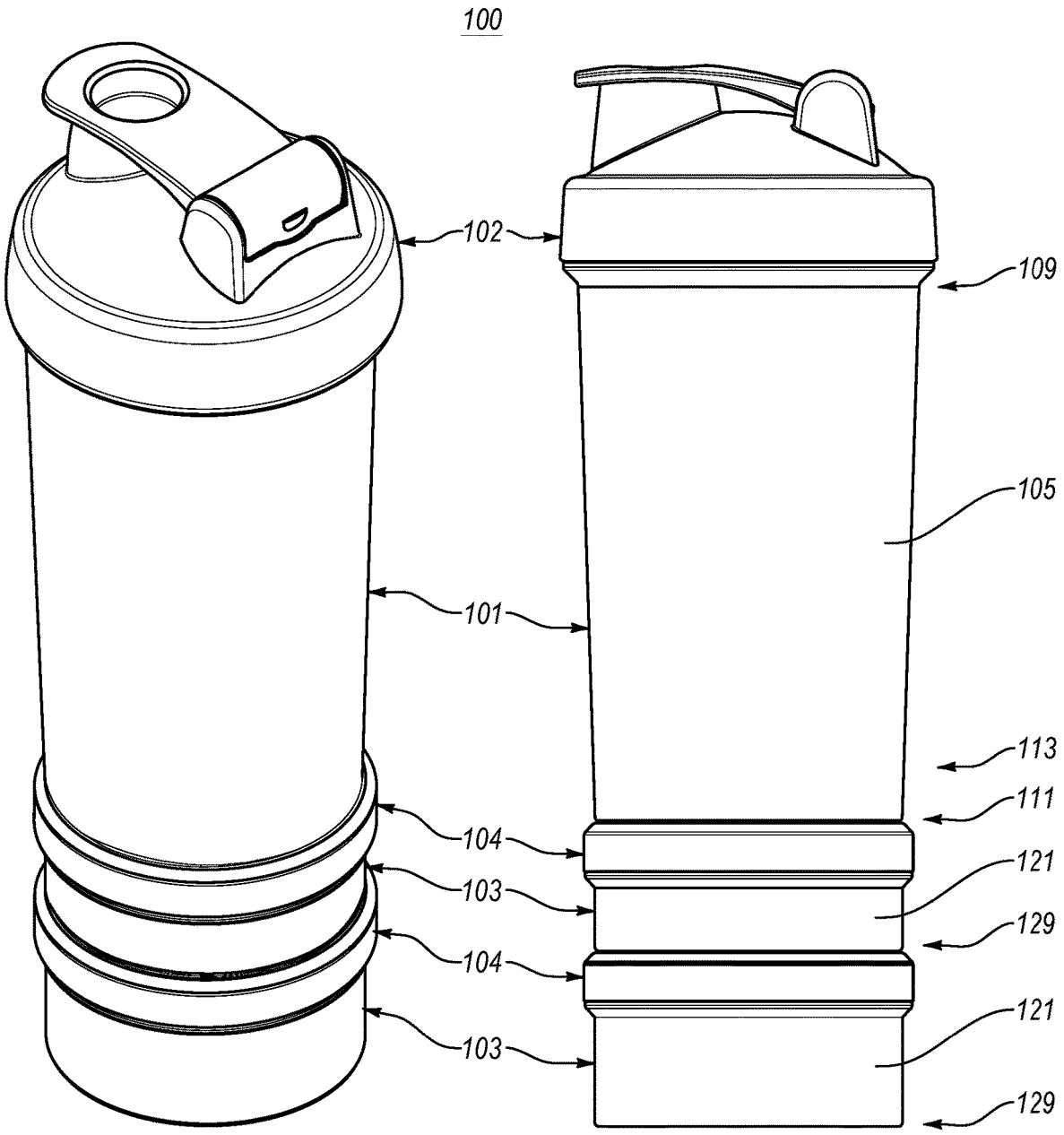
FIG. 1 illustrates two views of a stackable container system according to one or more embodiments of the invention.

FIG. 1 illustrates two views of a stackable container system 100 in accordance with one or more embodiments of the invention. As shown, stackable container system 100 includes a beverage container 101 with a beverage container lid 102, and two smaller containers 103 that each includes a lid 104.

Although stackable container system 100 is shown having two smaller containers with lids, in some embodiments, a stackable container system can have one or more smaller containers with lids that interconnect with beverage container 101. Further, the stackable container system of the present invention is not limited to any particular type of beverage container and beverage container lid such as those shown in FIG. 1. For example, a beverage container and beverage container lid in some embodiments of the stackable container system can be a baby bottle and nipple or another type of bottle and lid for containing and/or dispensing any type of beverage or pourable substance.

Figure 2:
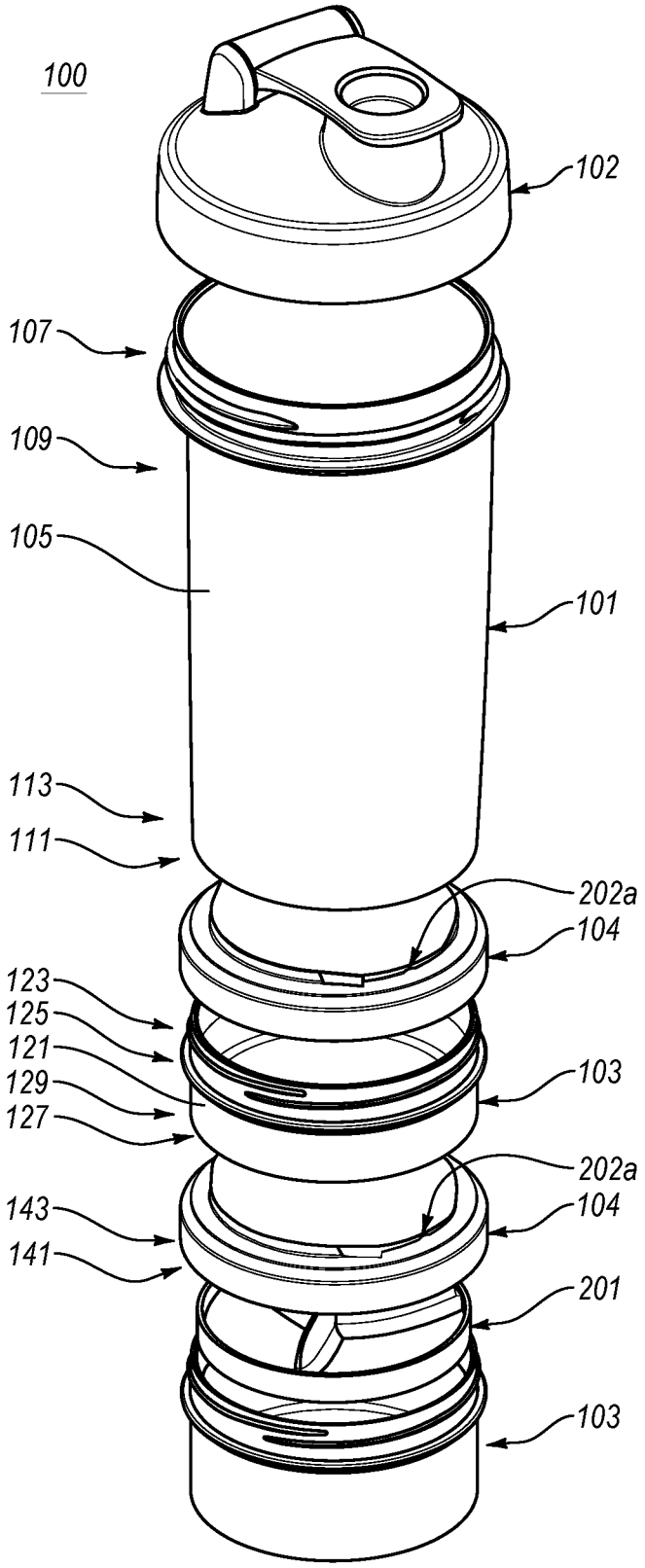
FIG. 2 illustrates an exploded view of the stackable container system of FIG. 1.

Each of lids 104 can be attached to either of smaller containers 103 (e.g. via threads (either on the inside or outside of smaller containers 103) as shown in FIG. 2 or other means as known in the art). The top of each of lids 104 is also configured to allow lid 104 to be attached to the bottom of beverage container 101 or either of smaller containers 103. In this manner, with lids 104 secured to smaller containers 103, smaller containers 103 and beverage container 101 can be interconnected to form a stack as shown in FIG. 1.

Because each container (beverage container 101 and smaller containers 103) includes a separate lid (beverage container lid 102 and lids 104), each container is independently sealable. In other words, stackable container system 100 comprises three containers that can each be sealed and used independently of the other containers, while still being interconnectable to form a single stackable container system.

FIG. 2 illustrates an exploded view of stackable container system 100. In addition to the components shown in FIG. 1, FIG. 2 also illustrates that stackable container system 100 can include a divider 201. Divider 201 can be configured to be inserted into one or more of smaller containers 103. The stackable container system of the present invention can include a single divider 201 (which may be inserted into one or more of the smaller containers), or more than one divider 201 (which may each be inserted into any of the smaller containers or which may each be configured to be inserted into a single specific smaller container).

Divider 201 is shown as having a base and three compartments. Accordingly, divider 201 provides three separate compartments for storing ingredients, pills, or other items as desired. Of course, a divider having fewer or more than three compartments could also be provided.

In some embodiments, each smaller container 103 that is configured to store divider 201 can include means for supporting divider 201. In some embodiments, this means can include a lip that extends around the inside wall of smaller container 103 on top of which divider 201 rests. One benefit of configuring smaller container 103 with a lip or other means for supporting divider 201 is that a space can be maintained within smaller container 103 and below divider 201 when divider 201 is inserted into smaller container 103. In other words, when a divider 201 providing three compartments is used, four separate compartments can be formed within smaller container 103 (one below divider 201 and three above (or within) divider 201).

Divider 201 can be configured to have a different depth than is shown in FIG. 2. In other words, the distance between the base and the top of divider 201 can be greater than or less than the distance shown in FIG. 2. Also, in some embodiments, divider 201 can be configured without a base in which case divider 201 can be placed in contact with the inside bottom surface of container 103 such that the inside bottom surface acts as a base for divider 201.

FIG. 2 also illustrates that lids 104 can be interconnected with the bottom of beverage container 101 or the bottom of a smaller container 103 using a bayonet mount. Although a bayonet mount is shown in FIG. 2, any type of connection can be used to secure lids 104 to the bottom of smaller containers 103 or beverage container 101 including by threading, snapping, twisting, sliding, or screwing lids 104 onto the bottom of the containers 101, 103.

Figure 3:
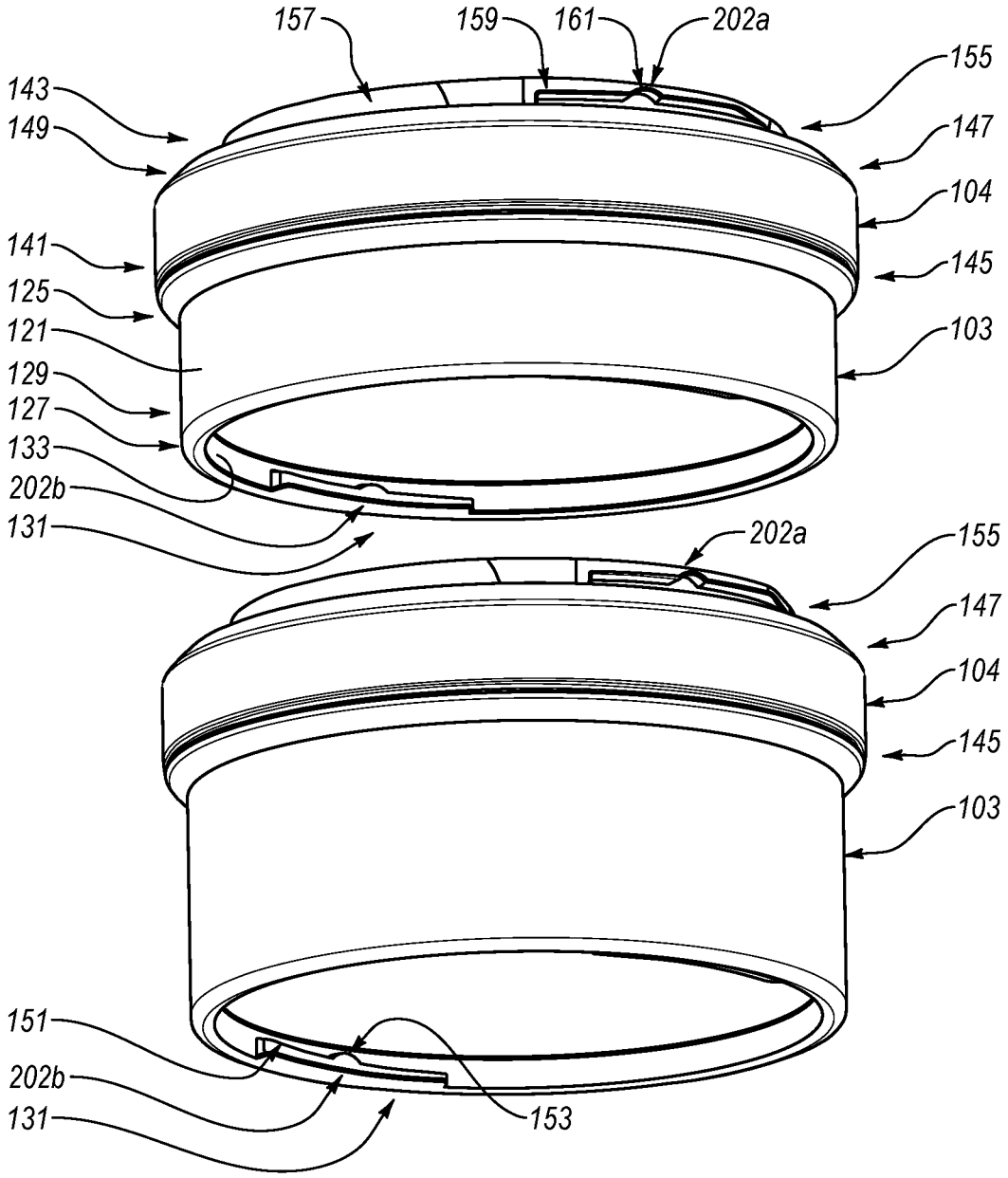
FIG. 3 illustrates an exploded view of two smaller containers with smaller container lids according to one or more embodiments of the invention.

In FIG. 2, a female side 202*a* of the bayonet mount is shown as being formed within the top surface of lids 104. As shown in FIG. 3, a corresponding male portion 202*b* of the bayonet mount can be formed within the bottom of smaller containers 103. A similar male portion can also be formed within the bottom of beverage container 101. Male portion 202*b* can be twisted into female portion 202*a* to lock a lid to the bottom of a container.

In some embodiments, the female and male portions 202*a*, 202*b* of the bayonet mount can be universal thus allowing any lid 104 to be connected to the bottom of any of beverage container 101 and smaller containers 103. Further, the male and female portions could be equally formed on the top of lids 104 and the bottom of the containers respectively. However, one benefit of forming the male portion on the bottom of the containers is that it can allow a less rigid material to be used for lids 104.

The stackable container system of the present invention can be used to store ingredients separately until the user desires to mix the ingredients. For example, a user can put ingredients for a protein shake in smaller containers 103 (with or without using divider 201). Once the user desires to mix the protein shake, he can remove smaller containers 103 to add their contents to beverage container 101, add liquid if necessary to beverage container 101, and mix the contents within beverage container 101.

In greater detail, as shown in FIGS. 1-3, the stackable container system 100 may include a beverage container 101. The beverage container 101 may include a body, such as a beverage container body 105, and a portion that is sized and configured to be connected to a lid, such as a beverage container lid connecting portion 107. The beverage container lid connecting portion 107 may be disposed at least proximate an upper portion 109 of the beverage container body 105. The beverage container 101 may also include an annular flange 111 and the flange may extend downwardly from a lower portion 113 of the beverage container body 105. In addition, the beverage container 101 may include a lid connecting portion disposed on an interior wall of the annular flange 111 of the beverage container body 105. The beverage container lid 102 may be selectively attached to the beverage container lid connecting portion 107. The system 100 may include one or more, such as a plurality, of smaller containers 103 and the smaller containers may be sized and configured to be interchangeably connected to the beverage container 101 and other smaller containers 103. The smaller containers 103 may include a smaller container body 121, a threaded connecting portion 123 disposed at least proximate an upper portion 125 of the smaller container body 121, an annular flange 127 extending downwardly from a lower portion 129 of the smaller container body 121, and a lid connecting portion 131 disposed on an interior wall 133 of the annular flange 127 of the smaller container body 121. The system 100 may include one or more, such as a plurality, of the smaller container lids 104 and the smaller container lids may be sized and configured to be selectively attached to the threaded connecting portion 123 of the smaller containers 103. The smaller container lids 104 may include a first connecting structure 141, such as an annular flange, that is sized and configured to be attached to the threaded connecting portion 123 of the smaller containers 103. The smaller container lids 104 may further include a second connecting structure 143, such as a container connecting portion, and the second connecting structure may be interchangeably connectable to the lid connecting portion 131 of the smaller container 103 (which may be referred to as smaller container lid connecting portion) and the lid connecting portion of the beverage container 101.

As shown in the accompanying figures, the stackable container system 100 may include the beverage container 101 and the beverage container may include the body 105, the beverage container lid connecting portion 107, which may be disposed at least proximate the upper portion 109 of the beverage container body 105, the annular flange 111 extending downwardly from the lower portion 113 of the beverage container body 105, and the lid connecting portion disposed on the interior portion of the annular flange 111 of the beverage container body 105. The beverage container lid 102 may be connected to the beverage container lid connecting portion 107 of the beverage container 101. The one or more, or plurality, of the smaller containers 103 may be sized and configured to be interchangeably connected to the beverage container 101 and other smaller containers. Each smaller container 103 of the plurality of smaller containers may include the smaller container body 121, the threaded connecting portion 123 disposed at least proximate the upper portion 125 of the smaller container body 121, the annular flange 127 extending downwardly from the lower portion 129 of the smaller container body 121, and the lid connecting portion 131 disposed on the interior portion 133 of the annular flange 127 of the smaller container body 121. The system 100 may include a plurality of the smaller container lids 104 and the smaller container lids may be sized and configured to be selectively attached to the threaded connecting portion 123 of the smaller containers 103. The smaller container lids 104 may include the first connecting structure 141, which may be sized and configured to interchangeably connect the lid to one of the smaller containers 103, and a second connecting structure 143, which may be sized and configured to connect the smaller container lid 104 to one of the smaller containers 103 or the beverage container 101. The first connecting structure 141 may be disposed on a first side 145 of the lid 104 and the second connecting structure 143 disposed on a second side 147 of the lid 104, and a central portion 149, such as an annular ring or tapered portion, may be disposed between the first connecting structure on the first side of the lid and the second connecting structure on the second side of the lid. Additionally, the first connecting structure 141 may be a different type of connecting structure than the second connecting structure 143.

As discussed above, FIGS. 1-3 show the stackable container system 100 may include a beverage container 101. The beverage container 101 may include the body 105, the annular flange 111 extending downwardly from the lower portion 113 of the body 105, and the lid connecting portion on the inner surface of the annular flange 111. The system 100 may also include a plurality of the smaller containers 103 and the smaller containers may be sized and configured to be interchangeably connected to the beverage container 101 and/or other smaller containers 103. The smaller containers 103 may include the body 121, the annular flange 127 extending downwardly from the lower portion 129 of the body 121, and the smaller container lid connecting portion 131 extending inwardly from the inner surface 133 of the annular flange 127 of the smaller container body 121. The system 100 may further include a plurality of the smaller container lids 104. The smaller container lids 104 may be sized and configured to interchangeably connect the smaller containers 103 and/or interchangeably connect the smaller containers 103 to the beverage container 101. The smaller container lid 104 may include the first connecting structure 141, which may be sized and configured to be connected to the upper portion 125 of the smaller container body 121. The smaller container lid 104 may include the second connecting structure 143, which may be sized and configured to be connected to the smaller container lid connecting portion 131 of the smaller containers 103 and the lid connecting portion of the beverage container 101. The smaller container lid connecting portion 131 may include a base 151 and an engaging member 153. The base 151 may extend inwardly from the inner surface 133 of the annular flange 127 and the base may include a planar lower surface that is generally aligned and disposed in the same plane as the lower surface of the annular flange. The base 151 may also form an inwardly extending portion or protrusion from the inner surface of 133 of the annular flange 127 of the smaller container body 121. An upper surface of the base 151 may be tapered or angled, and the engaging member 153 may be centrally disposed on the upper surface of the base. For example, as shown in FIG. 3, the engaging portion 153 may form a centrally disposed dome-shaped protrusion on the upper surface of the base 151. A receiving portion 155 of the second connecting structure 143 of the smaller container lid 104 may be sized and configured to receive at least a portion of the base 151 and the engaging member 153 when, for example, the smaller container lid 104 is connected to a smaller container 103. In addition, the lid connecting portion of the beverage container 101 and the lid connecting portion 131 of the smaller container 103 may be at least partially disposed in the receiving portion 155 of the second connecting structure 143 when the smaller container lid 104 is connected to the beverage container 101 or the smaller container 103. As shown in FIGS. 2 and 3, the receiving portion 155 of the second connecting structure 143 of the smaller container lid 104 may have the configuration of a slot, space or opening. When the base 151 is at least partially disposed in the receiving portion 155 and the engaging member 153 is at least partially disposed in the receiving portion 161, the upper portion of the smaller container lid 104 may be connected to the lid connecting portion of the beverage container 101 or the smaller container lid connecting portion 131. This type of connection may be referred to as a bayonet-type connection.

As seen in FIGS. 2-3, the system 100 may include a plurality of the smaller container lids 104 that may be sized and configured to interchangeably connect the smaller containers 103 and/or interchangeably connect the smaller containers 103 to the beverage container 101. As previously discussed, the smaller container lid 104 may include the second connecting structure 143, such as upwardly extending connecting portion, that is sized and configured to be selectively connected to the lid connecting portion 131 of the smaller containers 103 and the lid connecting portion of the beverage container 101. In addition, as previously mentioned, the upwardly extending connecting portion of the second connecting structure 143 may form part of the female portion of the mount 202*a* and the smaller container lid connecting portion 131 may form part of the male portion of the mount 202*b*. In greater detail, for example, the upwardly extending connecting portion 143 may include an outer wall 157 and the female portion of the mount 202*a* may include a flange 159 that extends outwardly from the outer wall. A lower portion of the flange 159 may include the receiving portion 161, such as a recess, groove, or indentation. As shown in FIGS. 2 and 3, the receiving portion 161 may have a generally semi-circular configuration and it may be generally centered along a length of the lower portion of the flange 159.

The male portion of the mount 202*b* is preferably complementary to the female portion of the mount 202*a*. For instance, as shown in the accompanying figures, the male portion of the mount 202*b* may include an inwardly extending flange 151 on the interior wall 133 of the annular flange 127. The inwardly extending flange 151 may include engaging portion 153, such as a projection, protrusion, or protuberance. The engaging portion 153 on the inwardly extending flange 151 of the male portion of the mount 202*b* is preferably sized and configured to be at least partially disposed in the receiving portion 161 of the outwardly extending flange 159 of the female portion of the mount 202*a*, when the lid 104 is connected to the smaller container 103 or the beverage container 101. In greater detail, the male portion of the mount 202*b* may be at least partially disposed in the female portion of the mount 202*a*, and the female portion of the mount 202*a* and/or the male portion of the mount 202*b* may be rotated or moved so that the engaging portion 153 on the inwardly extending flange 151 of the male portion of the mount is at least partially disposed in the receiving portion 161 of the outwardly extending flange 159 of the female portion of the mount. Advantageously, this may allow the smaller container lid 104 to be securely and selectively attached to the beverage container 101 or a smaller container 103. In addition, when the engaging portion 153 on the inwardly extending flange 151 of the male portion of the mount 202*b* is at least partially disposed in the receiving portion 161 of the outwardly extending flange 159 of the female portion of the mount 202*a*, the outwardly extending flange of the female portion of the mount may at least partially abut the inwardly extending flange of the male portion of the mount.

As illustrated in FIGS. 2 and 3, for example, the stackable container system 100 may include a beverage container 101, a beverage container lid 102, a plurality of smaller containers 103, and a plurality of smaller container lids 104. In greater detail, the beverage container 101 may include the beverage container body 105; the beverage container lid connecting portion 107 disposed at least proximate the upper portion 109 of the beverage container body 105; the annular flange 111 extending downwardly from the lower portion 113 of the beverage container body 105; and the lid connecting portion disposed on the interior wall of the annular flange 111 of the beverage container body 105. The beverage container lid 102 may be selectively attached to the beverage container lid connecting portion 107. The plurality of smaller containers 103 may be sized and configured to be interchangeably connected to the beverage container 101 and other smaller containers 103. Each of the smaller containers 103 of the plurality of smaller containers may include the smaller container body 121; the threaded connecting portion 123 disposed at least proximate the upper portion 125 of the smaller container body 121; the annular flange 127 extending downwardly from the lower portion 129 of the smaller container body 121; and the lid connecting portion 131 disposed on the interior wall 133 of the annular flange 127 of the smaller container body 121. The plurality of smaller container lids 104 may be sized and configured to be selectively attached to the threaded connecting portion 123 of the smaller containers 103. Each of the smaller container lids 104 of the plurality of smaller container lids may include the annular flange 127 sized and configured to be attached to the threaded connecting portion 123 of the smaller containers 103; and the container connecting portion 143 that is interchangeably connectable to the lid connecting portion 131 of the smaller container 103 and the lid connecting portion of the beverage container 101. Additionally, the container connecting portion 143 of the smaller container lids 104 may include an outwardly extending flange 159 and a receiving portion 161 disposed in the outwardly extending flange, which may be part of the female portion of the mount 202*a*. The lid connecting portion of the beverage container 101 and the lid connecting portion of the smaller containers 103 may include an inwardly extending flange 151 and an engaging portion 153, which may be part of the male portion of the mount 202*b*. In addition, the outwardly extending flange 159 of the container connecting portion 143 of the smaller container lids 104 may at least partially abut the inwardly extending flange 151 of the lid connecting portion 131. Further, the engaging portion 153 of the lid connecting portion of the beverage container 101 and the lid connecting portion 131 of the smaller containers 103 may be at least partially disposed in the receiving portion 155 of the container connecting portion of the smaller container lids. Advantageously, this may allow the beverage container 101, smaller containers 103 and lids 104 to be selectively connected in various combinations and arrangements.

The stackable container system can also be used to store ingredients for and later mix the ingredients for any type of beverage or pourable substance such as, for example, baby formula, ingredients for salad dressing, ingredients for pancake batter, nutritional drink mixes, ingredients for inedible substances (e.g. paints), etc. Accordingly, the stackable container system should not be limited to any particular use (including to uses for mixing edible substances), but should extend to a stackable container system for storing and/or mixing ingredients whether the ingredients are for a beverage or other edible mix or for an inedible mix.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A stackable container system comprising:

a beverage container comprising:

a beverage container body;

a beverage container lid connecting portion disposed at least proximate an upper portion of the beverage container body, the beverage container lid connecting portion comprising a threaded connecting portion disposed on the upper portion of the beverage container body;

a lower portion at a bottom of the beverage container body; and a smaller container lid connecting portion disposed on the lower portion of the beverage container, the smaller container lid connecting portion comprising a first portion of a bayonet mount including a first flange that extends radially from the lower portion and a first engaging portion;

a beverage container lid selectively connected to the beverage container lid connecting portion of the beverage container, the beverage container lid comprising an opening and a closure, the closure sized and configured to selectively close the opening in the lid, the beverage container lid including a threaded connecting portion disposed on an annular wall;

at least one smaller container sized and configured to be selectively connected to the beverage container, each smaller container comprising:

a smaller container body; and a threaded connecting portion disposed at least proximate an upper portion of the smaller container body, the threaded connecting portion of the smaller container disposed on the upper portion of the smaller container body; and at least one smaller container lid sized and configured to be selectively connected to the threaded connecting portion of the smaller container and the smaller container lid connecting portion of the beverage container, each smaller container lid comprising:

a first connecting structure on a first side of the smaller container lid, the first connecting structure comprising a threaded connecting portion on a downwardly extending flange that is selectively connected to the threaded connecting portion of the smaller container;

a second connecting structure on a second side of the smaller container lid, the second connecting structure comprising:

an upwardly extending portion with a top surface;

a second portion of a bayonet mount including a second flange that extends radially from the upwardly extending portion, the second flange having a top surface that is flush with a perimeter of the top surface of the upwardly extending portion; and a second engaging portion included in the second portion of the bayonet mount, the second engaging portion sized and configured to selectively mutually engage with the first engaging portion of the smaller container lid connecting portion when the smaller container lid is connected to the smaller container lid connecting portion of the beverage container; and a central portion disposed between and separating the first connecting structure and the second connecting structure of the smaller container lid, the first connecting structure and the second connecting structure comprising different types of connecting structures;

wherein the second flange of the second connecting structure of the smaller container lid at least partially abuts the first flange of the smaller container lid connecting portion of the beverage container when the smaller container lid is connected to the beverage container; and wherein the threaded connecting portion of the smaller container is at least partially disposed in the first connecting structure of the smaller container lid when the smaller container is connected to the smaller container lid.

2. The stackable container system of claim 1, wherein the threaded connecting portion of the beverage container lid connecting portion of the beverage container has a larger diameter than the threaded connecting portion of the smaller container.

3. The stackable container system of claim 1, wherein a diameter of the lower portion of the beverage container body and a diameter of the smaller container body are at least generally equal.

4. The stackable container system of claim 1, wherein the beverage container body has a tapered configuration with a larger upper diameter and a smaller lower diameter, the lower diameter of the beverage container body at least generally equal to a diameter of the smaller container body.

5. The stackable container system of claim 1, wherein:

the bayonet mount allows the smaller container lid to be selectively attached to the beverage container;

the beverage container lid is selectively connected to the beverage container by a first threaded connection that includes the threaded connecting portion of the beverage container lid and the threaded connecting portion of the beverage container;

the smaller container lid is selectively connected to the smaller container by a second threaded connection that includes the threaded connecting portion of the smaller container lid and the threaded connecting portion of the smaller container; and the first threaded connection and the second threaded connection are not compatible.

6. The stackable container system of claim 1, wherein each of the first flange of the beverage container and the second flange of the smaller container lid is tapered along its length.

7. The stackable container system of claim 1, wherein a bottom surface of the second flange of the smaller container lid is arranged at an angle relative to the top surface of the second flange of the smaller container lid such that the second flange of the smaller container lid is wedge-shaped.

8. The stackable container system of claim 1, wherein the first engaging portion of the beverage container comprises a protrusion and wherein the second engaging portion of the smaller container lid comprises a receiving portion configured to mate with the protrusion.

9. The stackable container system of claim 1, further comprising:

a lower portion at a bottom of the smaller container body of the smaller container; and a smaller container lid connecting portion disposed on the lower portion of the smaller container body and comprising a third portion of a bayonet mount including a third flange that extends radially from the lower portion of the smaller container body and a third engaging portion.

10. The stackable container system of claim 1, wherein:

the at least one smaller container comprises a plurality of interchangeable smaller containers; and the at least one smaller container lid comprises a plurality of interchangeable smaller container lids.

11. A stackable container system comprising:

a beverage container comprising:

a beverage container body;

a beverage container lid connecting portion disposed at least proximate an upper portion of the beverage container body, the beverage container lid connecting portion comprising a threaded connecting portion disposed on the upper portion of the beverage container body;

a lower portion at a bottom of the beverage container body; and a smaller container lid connecting portion disposed on the lower portion of the beverage container, the smaller container lid connecting portion comprising a first portion of a bayonet mount including a first flange that extends radially from the lower portion and a first engaging portion;

a beverage container lid selectively connected to the beverage container lid connecting portion of the beverage container, the beverage container lid comprising an opening and a closure, the closure sized and configured to selectively close the opening in the lid, the beverage container lid including a threaded connecting portion disposed on an annular wall;

at least one smaller container sized and configured to be selectively connected to the beverage container, each smaller container comprising:

a smaller container body; and a threaded connecting portion disposed at least proximate an upper portion of the smaller container body, the threaded connecting portion of the smaller container disposed on the upper portion of the smaller container body; and at least one smaller container lid sized and configured to be selectively connected to the threaded connecting portion of the smaller container and the smaller container lid connecting portion of the beverage container, each smaller container lid comprising:

a first connecting structure on a first side of the smaller container lid, the first connecting structure comprising a threaded connecting portion on a downwardly extending flange that is selectively connected to the threaded connecting portion of the smaller container;

a second connecting structure on a second side of the smaller container lid, the second connecting structure comprising:

an upwardly extending portion with a top surface;

a second portion of a bayonet mount including a second flange that extends radially from the upwardly extending portion, the second flange having a top surface, wherein a portion of the top surface of the second flange is contiguous with a portion of the top surface of the upwardly extending portion, and wherein the portion of the top surface of the second flange meets the portion of the top surface of the upwardly extending portion at a common height from a bottom of the smaller container lid; and a second engaging portion included in the second portion of the bayonet mount, the second engaging portion sized and configured to selectively mutually engage with the first engaging portion of the smaller container lid connecting portion when the smaller container lid is connected to the smaller container lid connecting portion of the beverage container; and a central portion disposed between and separating the first connecting structure and the second connecting structure of the smaller container lid, the first connecting structure and the second connecting structure comprising different types of connecting structures;

wherein the second flange of the second connecting structure of the smaller container lid at least partially abuts the first flange of the smaller container lid connecting portion of the beverage container when the smaller container lid is connected to the beverage container; and wherein the threaded connecting portion of the smaller container is at least partially disposed in the first connecting structure of the smaller container lid when the smaller container is connected to the smaller container lid.

12. The stackable container system of claim 11, wherein the threaded connecting portion of the beverage container lid connecting portion of the beverage container has a larger diameter than the threaded connecting portion of the smaller container.

13. The stackable container system of claim 11, wherein a diameter of the lower portion of the beverage container body and a diameter of the smaller container body are at least generally equal.

14. The stackable container system of claim 11, wherein the beverage container body has a tapered configuration with a larger upper diameter and a smaller lower diameter, the lower diameter of the beverage container body at least generally equal to a diameter of the smaller container body.

15. The stackable container system of claim 11, wherein:

the bayonet mount allows the smaller container lid to be selectively attached to the beverage container;

the beverage container lid is selectively connected to the beverage container by a first threaded connection that includes the threaded connecting portion of the beverage container lid and the threaded connecting portion of the beverage container;

the smaller container lid is selectively connected to the smaller container by a second threaded connection that includes the threaded connecting portion of the smaller container lid and the threaded connecting portion of the smaller container; and the first threaded connection and the second threaded connection are not compatible.

16. The stackable container system of claim 11, wherein each of the first flange of the beverage container and the second flange of the smaller container lid is tapered along its length.

17. The stackable container system of claim 11, wherein a bottom surface of the second flange of the smaller container lid is arranged at an angle relative to the top surface of the second flange of the smaller container lid such that the second flange of the smaller container lid is wedge-shaped.

18. The stackable container system of claim 11, wherein the first engaging portion of the beverage container comprises a protrusion and wherein the second engaging portion of the smaller container lid comprises a receiving portion configured to mate with the protrusion.

19. The stackable container system of claim 11, further comprising:

a lower portion at a bottom of the smaller container body of the smaller container; and a smaller container lid connecting portion disposed on the lower portion of the smaller container body and comprising a third portion of a bayonet mount including a third flange that extends radially from the lower portion of the smaller container body and a third engaging portion.

20. The stackable container system of claim 11, wherein:

the at least one smaller container comprises a plurality of interchangeable smaller containers; and the at least one smaller container lid comprises a plurality of interchangeable smaller container lids.

* * * * *